US010259685B2

(12) United States Patent
Fuchs

(10) Patent No.: US 10,259,685 B2
(45) Date of Patent: Apr. 16, 2019

(54) CONVEYOR DEVICE

(71) Applicant: Otis Elevator Company, Farmington, CT (US)

(72) Inventor: Wilfrid Fuchs, Langenzersdorf (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/754,769

(22) PCT Filed: Aug. 26, 2015

(86) PCT No.: PCT/EP2015/069523
§ 371 (c)(1),
(2) Date: Feb. 23, 2018

(87) PCT Pub. No.: WO2017/032414
PCT Pub. Date: Mar. 2, 2017

(65) Prior Publication Data

US 2018/0244503 A1 Aug. 30, 2018

(51) Int. Cl.
*B66B 21/04* (2006.01)
*B66B 23/24* (2006.01)
(Continued)

(52) U.S. Cl.
CPC ..... *B66B 29/005* (2013.01); *B66B 21/04* (2013.01); *B66B 23/24* (2013.01); *B66B 25/00* (2013.01)

(58) Field of Classification Search
CPC ..... B66B 29/005; B66B 21/04; B66B 23/24; B66B 25/00; B66B 29/00; B66B 25/006
See application file for complete search history.

(56) References Cited

U.S. PATENT DOCUMENTS 6,267,219 B1 * 7/2001 Spannhake ..... B66B 27/00 198/322
6,334,522 B2 1/2002 Haruta et al.
(Continued)

FOREIGN PATENT DOCUMENTS

CN 101456518 A 6/2009
CN 101486432 A 7/2009
(Continued)

OTHER PUBLICATIONS

"Patent Translate Description JP2014169158", EPO (Year: 2014).*
(Continued)

*Primary Examiner* — Mark A Deuble
(74) *Attorney, Agent, or Firm* — Cantor Colburn LLP

(57) ABSTRACT

A conveyor device (2) comprises: a conveyance element (8) extending in a longitudinal direction between two spaced apart landing portions (4, 6) and configured to move for conveying people and/or goods between the two landing portions (4, 6); at least one balustrade (10, 12) located laterally at one side of the conveyance element (8) and extending along the longitudinal direction of the conveyance element (8); and at least one sensor (22, 23), which is configured for detecting the presence of a person in a detection zone (28) which is defined by a main detection direction (D), at least one detection angle (α, β) and at least one detection range (R). The at least one sensor (22, 23) is located at or next to the at least one balustrade (10, 12), and the main detection direction (D) extends from the at least one sensor (22, 23) in a direction away from the balustrade (10, 12).

17 Claims, 4 Drawing Sheets

Figure 1:
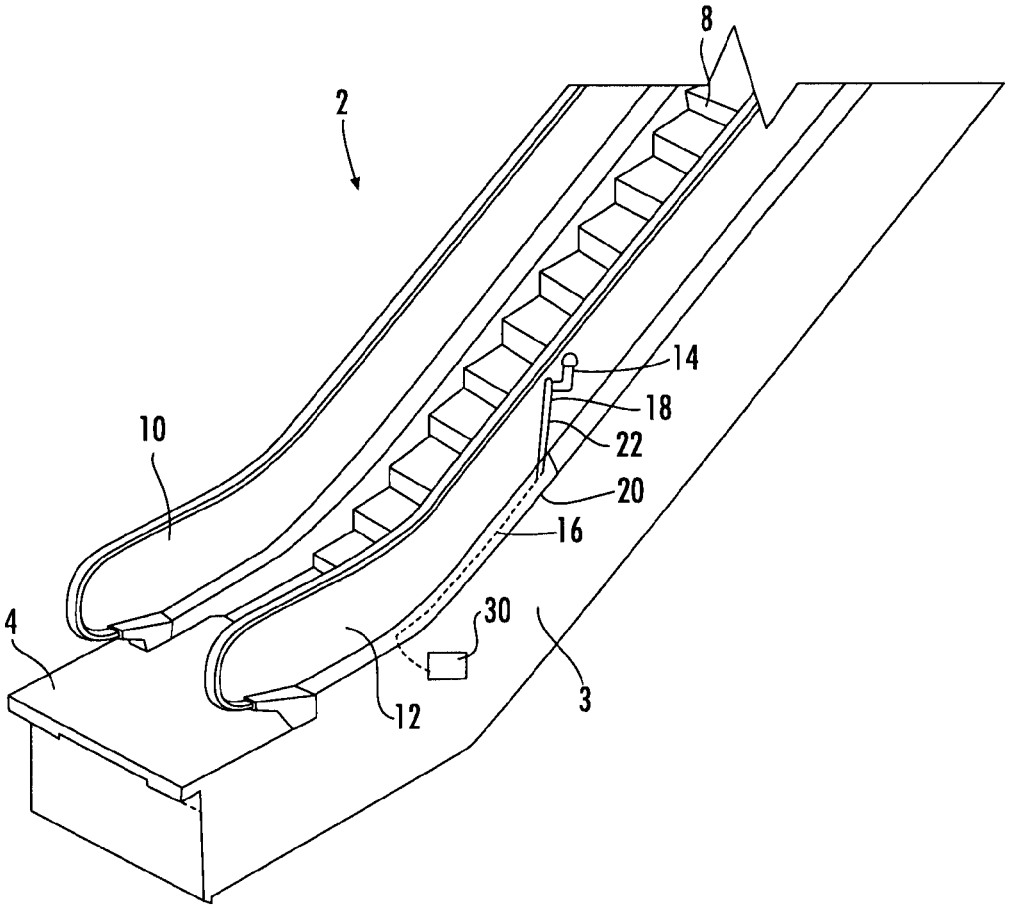

(51) Int. Cl.
*B66B 25/00* (2006.01)
*B66B 29/00* (2006.01)

(56) References Cited

U.S. PATENT DOCUMENTS

| | | | | |
|---|---|---|---|---|
| 7,404,477 | B1 | 7/2008 | Toennisson et al. | |
| 7,568,570 | B2 | 8/2009 | Stripling et al. | |
| 7,775,339 | B2 | 8/2010 | Ogimura | |
| 8,534,445 | B2 * | 9/2013 | Behan | B66B 29/005 198/323 |
| 8,589,118 | B2 * | 11/2013 | Idemori | B66B 29/005 702/151 |
| 2005/0088520 | A1 * | 4/2005 | Wiesinger | B66B 27/00 348/143 |
| 2011/0011700 | A1 | 1/2011 | Plathin et al. | |
| 2017/0305724 | A1 * | 10/2017 | Qi | B66B 27/00 |

FOREIGN PATENT DOCUMENTS

| | | | | | |
|---|---|---|---|---|---|
| CN | 103790403 | A | | 5/2014 | |
| CN | 204057636 | U | | 12/2014 | |
| EP | 0931754 | B1 | | 8/2004 | |
| EP | 2404860 | A1 | | 1/2012 | |
| JP | H06278982 | A | | 10/1994 | |
| JP | 2000219474 | A | | 8/2000 | |
| JP | 2000313570 | A | | 11/2000 | |
| JP | 2007153497 | A | | 6/2007 | |
| JP | 2007302363 | A | | 11/2007 | |
| JP | 2009196733 | A | * | 9/2009 | B66B 29/08 |
| JP | 2011116535 | A | | 6/2011 | |
| JP | 2011236009 | A | | 11/2011 | |
| JP | 2012006721 | A | | 1/2012 | |
| JP | 2012148832 | A | * | 8/2012 | B66B 29/08 |
| JP | 2013163568 | A | | 8/2013 | |
| JP | 2013249191 | A | | 12/2013 | |
| JP | 2014169158 | A | | 9/2014 | |
| KR | 20100116002 | A | | 10/2010 | |
| WO | 2005035423 | A1 | | 4/2005 | |
| WO | 2009126140 | A1 | | 10/2009 | |

OTHER PUBLICATIONS

"Patent Translate Description JP2013163568", EPO (Year: 2013).*

European Search Report for application EP 10860217.8, dated Jan. 8, 2018, 9 pages.

International Search Report and Written Opinion for PCT/EP2015/069523, dated May 23, 2016, 9 pages.

Pliem, V.A. et al., "Crack detection on an escalator handrail", Instrumentation and Measurement Technology Conference, 2002. IMTC/2002. Proceedings of the 19th IEEE, 2 pages.

Chinese First Office Action for application CN 2018122101760170, dated Dec. 26, 2018, 22 pages.

* cited by examiner

CONVEYOR DEVICE

The invention relates to a conveyor device which is configured for conveying people and/or goods and which includes at least one sensor configured for detecting the presence of people next to the conveyor device.

Conveyor devices are often provided in the form of escalators or inclined moving walks extending between two landing portions which are located at different levels of height. There is some risk that people, in particular children or teenagers, will hang on the moving handrail of the conveyor device from outside to be lifted by the handrail and fall down from some height, which may cause severe injuries or even death.

Safety codes therefore require barriers to prevent people from accessing the outer decking of escalators and inclined moving walks. Different kinds of mechanical barriers are used for preventing access to different arrangements of escalators and moving walks. Mechanical barriers, however, suffer from a plurality of disadvantages: If a wrong type of barrier is used, the risk of climbing the outer decking is not mitigated which results in non-compliance to the code. Architects often do not consider the barriers due to optical and design reasons. Customers and local installation companies sometimes do not realize the need for such barriers. Retrofitting already installed escalators and moving walks is not explicitly demanded by the code.

It therefore would be beneficial to provide an improved conveyor device with at least one handrail, which allows to reliably prevent people from hanging onto the handrail from outside the conveyor device.

A conveyor device according to an exemplary embodiment of the invention comprises:

- a conveyance element extending in a longitudinal direction between two spaced apart landing portions and configured to move for conveying people and/or goods between the two landing portions;
- at least one balustrade located laterally at one side of the conveyance element and extending along the longitudinal direction of the conveyance element;
- at least one sensor, which is configured for detecting the presence of a person in a detection zone which is defined by a main detection direction, a detection angle and a detection range.

The at least one sensor is located at or next to the at least one balustrade; and the main detection direction of the detection zone extends from the at least one sensor in a direction away from the balustrade.

The detection zone of the at least one sensor is in particular designed so that a person approaching the balustrade from the outside and/or hanging onto the handrail of the conveyor device is detected by the at least one sensor. In this case, an alarm signal may be issued in order to cause the person to leave the detection zone. Alternatively or additionally, the movement of the conveyor device may be stopped.

As a result, a conveyor device according to an exemplary embodiment of the invention allows to reliably prevent people residing outside the conveyance element from being pulled up by the moving handrail without using a mechanical barrier. As a result, it increases the safety of operating a conveyor device without suffering from the disadvantages which result from employing a mechanical barrier.

Exemplary embodiments of the invention will be described with respect to the enclosed figures:

FIG. 1 shows a perspective view of a conveyor device according to a first exemplary embodiment of the invention.

Figure 2B:
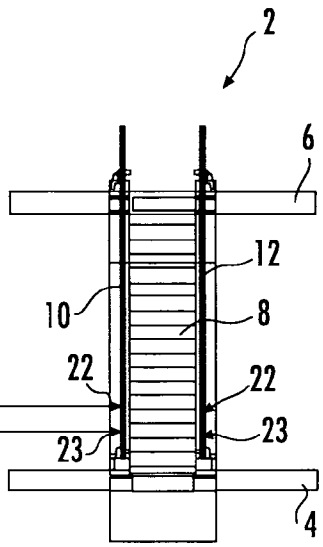
Figure 2A:
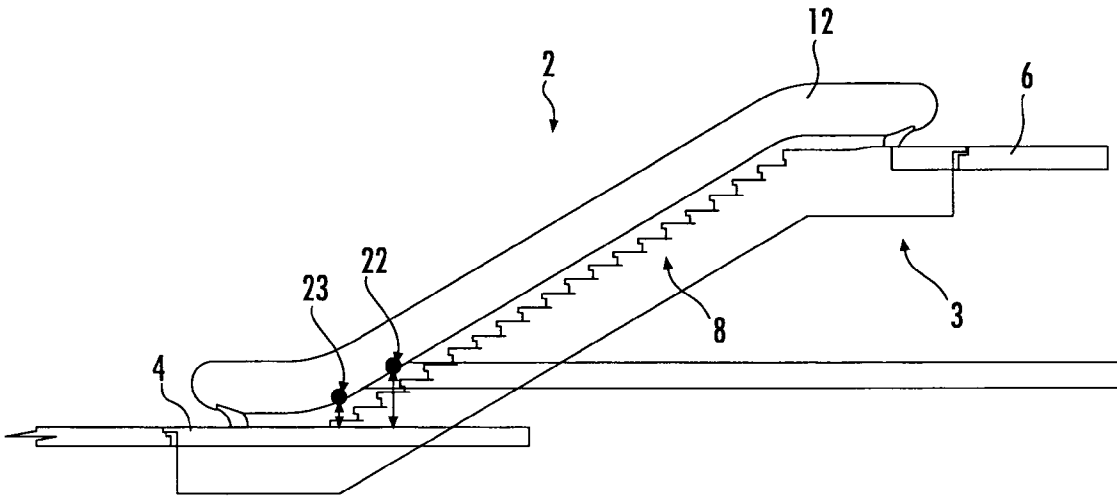

FIGS. 2*a*, 2*b* show perspective views of a conveyor device according to a second exemplary embodiment of the invention.

Figure 3A:
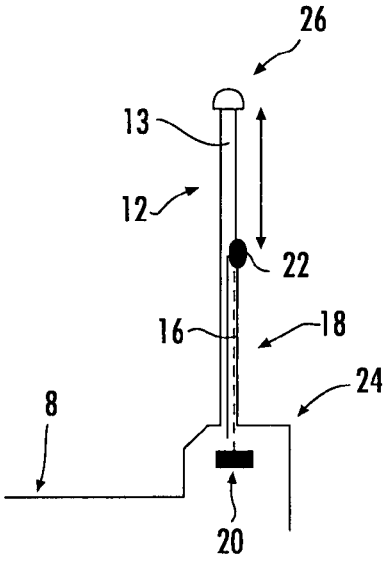
Figure 3B:
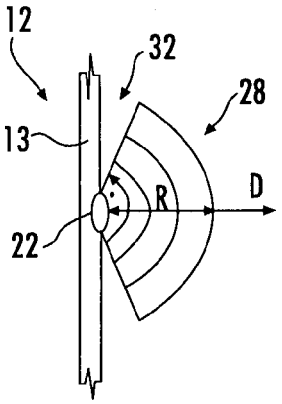
Figure 3C:
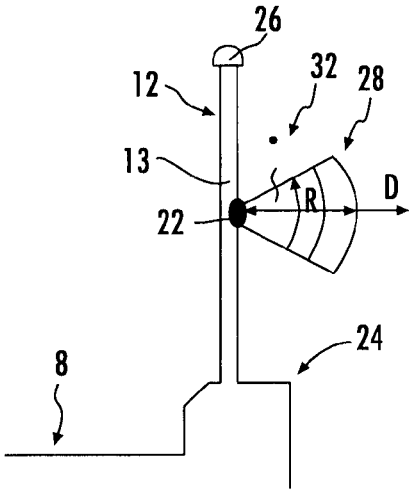

FIGS. 3*a* and 3*c* both show a schematical vertical sectional view through a balustrade according to an embodiment of the invention.

FIG. 3*b* shows a schematical horizontal sectional view through the balustrade shown in FIGS. 3*a* and 3*c*.

Figure 4A:
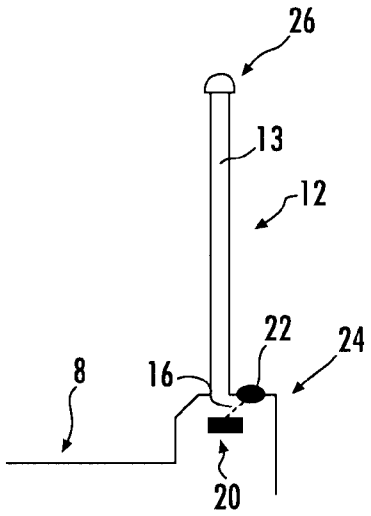
Figure 4B:
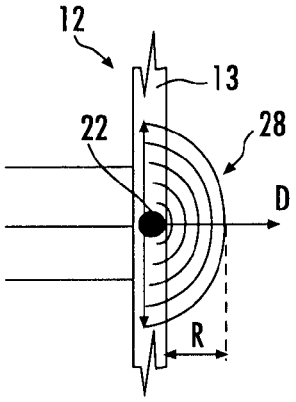
Figure 4C:
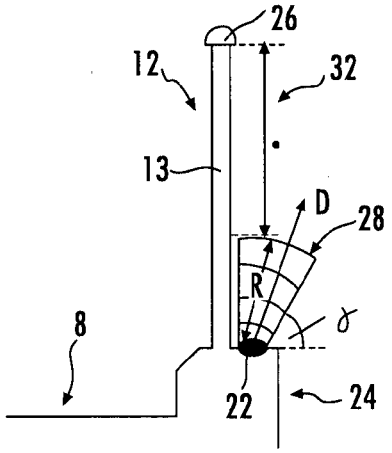

FIGS. 4*a* and 4*c* both show a schematical vertical sectional view through a balustrade according to another embodiment of the invention.

FIG. 4*b* shows a schematical horizontal sectional view through the balustrade shown in FIGS. 4*a* and 4*c*.

FIG. 1 shows a perspective view of a first embodiment of a conveyor device 2, which in this case is provided as an escalator.

The conveyor device 2 extends between a lower landing portion 4 and an upper landing portion (not shown in FIG. 1) and comprises a truss 3 supporting a conveyance element 8, which in this case is a step chain, and two balustrades 10, 12 residing laterally at both sides of the conveyance element 8.

An emergency stop button (safety switch) 14 is provided outside the right balustrade 12 when viewed in the conveying direction from the lower landing portion 4 to the upper landing portion. A balustrade cable channel 18 is formed inside the balustrade 12 housing a cable 16. The cable 16 extends from the emergency stop button 14 through the balustrade cable channel 18 and further along the bottom of the balustrade 12 to a control device 30 of the conveyor device 2.

In case of an emergency situation, any movement of the conveyance element 8 may be stopped immediately by pushing the emergency stop button 14.

A sensor 22 is arranged at the outside of the balustrade 12 below the emergency stop button 14. The sensor 22 in particular is located on the balustrade cable channel 18 allowing to use the balustrade cable channel 18 for electrically connecting the sensor 22 with the control device 30 by means of a cable 16. Alternatively, the sensor may transmit its signals to the control device 30 by means of a wireless connection (WLAN, Bluetooth, e.g.).

The sensor 22 is configured for detecting the presence of a person in a defined detection zone. The detection zone will be discussed in detail further below with reference to FIGS. 3*a* to 4*c*.

In case the sensor 22 detects the presence of a person within the detection zone, it will send a signal to the control device 30 which than will issue an optical and/or acoustic alarm signal. Additionally or alternatively, the control device 30 may stop the movement of the conveyance element 8.

FIGS. 2*a* and 2*b* respectively illustrate side views of a second embodiment of a conveyance device 2 extending between a lower landing portion 4 and an upper landing portion 6.

The elements which are identical with the elements of the first embodiment are denoted with the same reference signs and will not be discussed in detail again.

In the embodiments shown in FIGS. 2*a* and 2*b*, two sensors 22, 23 are arranged at each of the balustrades 10, 12. The sensors 22, 23 are arranged at different heights h1, h2 above the level of the lower landing portion 4.

Providing two or more sensors 22, 23 at each of the balustrades 10, 12 allows to enhance the reliability of detecting the presence of a person within an area outside the balustrades 10, 12.

In particular, in a configuration as it is shown in FIGS. 2*a* and 2*b*, an acoustic and/or an optical alarm may be issued, when the presence of a person within the detection zone of at least one of the lower sensors 23 has been detected. As the lower sensors 23 are arranged at a relatively low height h2 above the level of the lower landing area 4, there is no big risk that a person, which is present in said area, may fall down. Therefore it might be sufficient to trigger an optical and/or acoustical alarm signal in order to warn said person.

However, in case the presence of a person is detected within the detection zone of at least one of the upper sensors 22, said person already has been pulled up some distance from the level of the lower landing area 4. In consequence, the movement of the conveyance element 8 is stopped immediately in order to prevent said person from being pulled up even further to a dangerous height.

A skilled person will easily understand that the configuration comprising two sensors 22, 23 at each of the balustrades 10, 12, as it is shown in FIGS. 2*a* and 2*b*, is only an example, and that additional sensors 22, 23 may be provided at the balustrades 10, 12 in order to enhance the safety of the conveyor device 2 even further.

FIGS. 3*a* and 3*c* show a schematical vertical sectional view through a balustrade 12 comprising a sensor 22, and FIG. 3*b* shows a schematical horizontal sectional view thereof.

According to FIG. 3*a*, the sensor 22 is arranged in some distance d of e.g. 400 mm below the top of an upper vertical portion 13 of the balustrade 12 supporting a handrail 26. The sensor 22 is connected by means of a cable 16 extending vertically through a balustrade cable channel 18 to a basement cable channel 20, which is formed in a basement 24 of the balustrade 12 and extends in the conveying direction (orthogonally to the plane of FIG. 3*a*).

FIG. 3*b* schematically illustrates the detection zone 28 of the sensor 22 in a horizontal plane, and FIG. 3*c* schematically illustrates the detection zone 28 in a vertical plane.

In the illustrated embodiment, the detection zone 28 extends from the sensor 22 in the form of a cone centered around a main detection direction D, with the main detection direction D being oriented orthogonally to the plane of the balustrade 12.

The detection zone 28 comprises a detection range R of e.g. 300 mm from the sensor 22 with a detection angle $\alpha$ of 140° in the horizontal plane and a detection angle $\beta$ of 60° in the vertical plane.

The illustrated dimensions and angles, however, are only exemplarily and may be amended depending on the actual situation in order to ensure a reliable detection of a person hanging onto the handrail 26 of the conveyance device 8, but at the same time avoid any false alarms caused by a person laterally approaching the conveyance device 8 without hanging onto the handrail 26.

As shown in FIG. 3*c*, the detection angle $\beta$ in the vertical plane is set so that a non-detection area 32 is provided below the handrail 26 outside the balustrade 12. Providing a sufficient non-detection area 32 avoids that people standing on the conveyance element 8 and hanging their arm, hands or bags outside the balustrade 12 will trigger a false alarm.

FIGS. 4*a* to 4*c* schematically illustrate an alternative embodiment, in which the sensor 22 is not mounted to the vertically extending portion 13 of the balustrade 12, but to the basement 24 of said balustrade 12.

As it is illustrated in the vertical sectional view of FIG. 4*a*, the sensor 22 is located close to the basement cable channel 20 and thus there is no need for guiding the cable 16 through the vertically extending portion 13 of the balustrade 12.

This might be beneficial from an aesthetic point of view, especially when the vertically extending portion 13 of the balustrade 12 is at least partly transparent. It further reduces the costs for installing the sensor 22, as there is no need to provide an additional balustrade cable channel 18 within the vertical portion 13 of the balustrade 12.

The detection range 28 of the sensor 22 in a horizontal sectional view and in a vertical sectional view is shown in FIGS. 4*b* and 4*c*, respectively.

As illustrated in FIG. 4*b*, the detection angle in the horizontal plane is 180°.

As illustrated in FIG. 4*c*, in this configuration the detection range R is set so that the detection zone 28 ends in some distance d below the handrail 26, forming a non-detection zone 32 below the upper edge of the balustrade 12. In consequence, hands, arms or bags hanging over the handrail 26 will not be detected by the sensor 22 and therefore will not trigger a false alarm.

The outer edge of the detection zone 28 may be inclined, e.g. by an angle $\gamma$ of 60° with respect to the horizontal, as it is shown in FIG. 4*c*. Again, this angle as well as the detection range R may be amended in order to match the actual needs of the specific installation.

Although balustrades 10, 12 shown in the figures all extend in a vertical direction, the skilled person will understand that the invention may be employed to conveyors comprising inclined balustrades, as well.

FURTHER EMBODIMENTS

A number of optional features are set out in the following. These features may be realized in particular embodiments, alone or in combination with any of the other features.

In an embodiment the detection zone is located on a first side of the balustrade and the conveyance element is located on a second, opposite side of the balustrade. As a result, people approaching the balustrade from outside the conveyor device will enter the detection zone and will be detected by the sensor, whereas people and goods located on the conveyance element will not be detected by the sensor.

In an embodiment the balustrade defines a plane and the main detection direction of the sensor is oriented in an angle of 30°, 60° or 90° with respect to said plane. These orientations have been identified as advantageous for reliably detecting people hanging onto the handrail from outside the conveyor device without causing a large number of false alarms.

The balustrade may be oriented vertically or basically vertically, i.e. at an angle in the range of 70° to 90° with respect to the horizontal.

In an embodiment the shape of the detection zone is symmetric with respect to the main detection direction. This facilitates the mounting of the sensor(s) as they may be mounted in an arbitrary orientation.

In an embodiment the detection angle is in the range of 60° to 120°, in particular 60°, 90° or 120°. Such detection angles have been identified as advantageous for reliably detecting people hanging onto the handrail from outside the conveyor device without causing too many false alarms.

In an embodiment the detection zone extends up to a distance (detection range) of 250 mm to 350 mm, in particular 300 mm, from the sensor. A detection range in this order of magnitude has been identified as advantageous for reliably detecting people hanging onto the handrail from outside the conveyor device without causing too many false alarms.

In an embodiment the at least one balustrade comprises a basement and the at least one sensor is positioned at and/or in the basement of the balustrade. The basement provides an easy and advantageous possibility for mounting and electrically connecting the at least one sensor without much effort.

In an embodiment an emergency stop button, which is configured for stopping the movement of the conveyance element, is provided at or in at least one balustrade and the at least on sensor is located between the emergency stop button and the basement of the balustrade. This provides an easy way of mounting the sensor to the balustrade. In particular, a balustrade cable channel extending within the balustrade in a basically vertical direction and housing at least one cable connected to the emergency stop button may additionally house at least one cable connected to the at least one sensor. This avoids the need of providing an additional cable channel for housing the cable(s) connected to the at least one sensor.

The electrical wiring of the sensor(s) also may be combined with the electrical wiring of an illumination provided inside or at the balustrade.

In an embodiment the conveyor device is equipped with at least two sensors which are located in some distance from each other in the longitudinal and/or in the vertical direction. Providing a plurality of spaced apart sensors enhances the reliability of detecting people approaching the conveyor device.

In an embodiment the two landing portions are arranged at different levels of height. A first sensor is arranged at a first height, e.g. 50 mm, above the level of the lower landing portion, and a second sensor is arranged at a different second height, e.g. 100 mm, above the level of the lower landing portion. A configuration comprising at least two sensors, which are arranged at different heights above the level of the lower landing portion, allows a very reliable detection of people hanging on and being pulled up by a moving handrail.

In an embodiment the at least one sensor comprises at least one of an ultrasonic sensor, a radar sensor, an infrared sensor, an optical video sensor, and a LIDAR sensor. Each of these sensors may provide a reliable sensor for detecting the presence of a person in the detection zone, which is defined by the sensor. The most appropriate type of sensor may be selected based on the actual circumstances, e.g. dimensions of the required detection zone, level of noise, ambient light, etc.

In an embodiment a basement cable channel extending basically in the longitudinal direction is formed in the basement of the balustrade and houses at least one cable connected to the at least one sensor. Using a basement cable channel allows an easy wiring of the at least one sensor.

In an embodiment the conveyor device further comprises a control device which is configured for issuing an alarm signal and/or for stopping any movement of the conveyance element when the presence of at least one person within the detection area of at least one sensor is detected.

The alarm signal may cause the detected person to leave the detection zone. Alternatively or additionally, the movement of the conveyor device may be stopped. The movement in particular may be stopped in case the presence of a person in the detection zone is detected for more than a predetermined period of time and/or when the presence of a person is detected by a sensor having a detection zone located in some height about the lower landing portion indicating that the person already has been started to being pulled up by the moving handrail.

In an embodiment the conveyor device is provided in the form of an escalator, wherein the conveyance element is a step band comprising a plurality of steps. In the case of an escalator extending between two different levels of height, the risk of getting injured when falling from the balustrade is particularly high, and thus it is particularly advantageous to reliably detect people hanging onto the handrail and/or the balustrade of the escalator.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the dependent claims.

REFERENCES

2 conveyor device
4 lower landing portion
6 upper landing portion
8 conveyance element
10 first balustrade
12 second balustrade
13 vertical portion of the balustrade
14 emergency stop button
16 cable
18 balustrade cable channel
20 basement cable channel
22 (upper) sensor
23 (lower) sensor
24 basement
26 handrail
28 detection zone
30 control device
32 non-detection zone
d distance of the detection zone from the upper edge of the balustrade
D main detection direction
R detection range
$\alpha$ detection angle in a horizontal plane
$\beta$ detection angle in a vertical plane
$\gamma$ angle of the detection zone with respect to the horizontal

The invention claimed is:

1. Conveyor device comprising:

a conveyance element extending in a longitudinal direction between two spaced apart landing portions and configured to move for conveying people and/or goods between the two landing portions;

at least one balustrade located laterally at one side of the conveyance element and extending along the longitudinal direction of the conveyance element; and at least one sensor, which is configured for detecting the presence of a person in a detection zone which is centered around a main detection direction (D), the detection zone further defined by at least one detection angle ($\alpha$, $\beta$) being defined as an opening angle of the detection zone within a predefined plane extending from the at least one balustrade, and at least one detection range (R);

wherein the at least one sensor is located at or next to the at least one balustrade; and wherein the main detection direction (D) extends from the at least one sensor in a direction away from the balustrade on a side opposite to the conveyance element; and wherein the main detection direction (D) of the sensor is oriented in an angle of 30° to 90° with respect to the at least one balustrade.

2. Conveyor device of claim 1, wherein the detection zone is located on a first side of the balustrade and the conveyance element is located on a second, opposite side of the balustrade.

3. Conveyor device of claim 1, wherein the balustrade defines a plane and the main detection direction (D) of the sensor is oriented in an angle of 30°, 60° or 90° with respect to said plane.

4. Conveyor device of claim 3, wherein the detection zone is symmetric with respect to the main detection direction (D).

5. Conveyor device of claim 1, wherein the at least one detection angle (α, β) is in the range of 60° to 120°.

6. Conveyor device of claim 1, wherein the detection zone extends over a detection range (R) of 250 mm to 350 mm from the sensor.

7. Conveyor device of claim 1, wherein the at least one balustrade comprises a basement and the at least one sensor is located at and/or in the basement of the balustrade.

8. Conveyor device of claim 1, wherein an emergency stop button, which is configured for stopping the movement of the conveyance element, is provided at the balustrade and the at least one sensor is located between the emergency stop button and the basement of the balustrade.

9. Conveyor device of claim 8, further comprising a balustrade cable channel extending within the balustrade in a basically vertical direction and housing at least one cable connected to the emergency stop button and/or at least one cable connected to the at least one sensor.

10. Conveyor device of claim 1 comprising at least two sensors which are located in some distance from each other in the longitudinal and/or in the vertical direction.

11. Conveyor device of claim 10, wherein the two landing portions are arranged at different levels of height and wherein a first sensor is arranged at a first height (h1) above the level of the lower landing portion and a second sensor is arranged at a second, lower height (h2) above the level of the lower landing portion.

12. Conveyor device of claim 1, wherein the at least one sensor comprises at least one of an ultrasonic sensor, a radar sensor, an infrared sensor, an optical video sensor, and a LIDAR sensor.

13. Conveyor device of claim 1, comprising a basement cable channel, which is formed in the basement of the balustrade extending basically in the longitudinal direction, and which houses at least one cable connected to the at least one sensor.

14. Conveyor device of claim 1, comprising a control device which is configured for issuing an alarm signal and/or stopping any movement of the conveyance element when the presence of at least one person is detected in the detection area of the at least one sensor.

15. Conveyor device of claim 1 having the form of an escalator, wherein the conveyance element is a step band comprising a plurality of steps.

16. The conveyor device of claim 5 wherein the at least one detection angle (α, β) has a value of 60°, 90° or 120°.

17. The conveyor device of claim 5 wherein the detection range (R) is 300 mm from the sensor.

* * * * *